US011724166B2

(12) United States Patent
Golden et al.

(10) Patent No.: US 11,724,166 B2
(45) **Date of Patent: *Aug. 15, 2023**

(54) GOLF CLUB HAVING DAMPING TREATMENTS FOR IMPROVED IMPACT ACOUSTICS AND BALL SPEED

(71) Applicant: Acushnet Company, Fairhaven, MA (US)

(72) Inventors: Charles E. Golden, Encinitas, CA (US); Michael E. Franz, San Diego, CA (US); Jonathan Hebreo, San Diego, CA (US); Brian Comeau, Berkley, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/910,443

(22) Filed: Jun. 24, 2020

(65) Prior Publication Data

US 2021/0008423 A1 Jan. 14, 2021

Related U.S. Application Data

(63) Continuation of application No. 16/117,777, filed on Aug. 30, 2018, now Pat. No. 10,716,985, which is a (Continued)

(51) Int. Cl.

| | |
|---|---|
| ***A63B 60/54*** | (2015.01) |
| ***A63B 53/04*** | (2015.01) |
| *A63B 60/00* | (2015.01) |

(52) U.S. Cl.

CPC ..... *A63B 60/54* (2015.10); *A63B 53/047* (2013.01); *A63B 53/0475* (2013.01); *A63B 53/0408* (2020.08); *A63B 60/002* (2020.08)

(58) Field of Classification Search

CPC ..... A63B 53/047; A63B 53/0475; A63B 53/0408; A63B 60/54; A63B 60/002; A63B 60/00

(Continued)

(56) References Cited

U.S. PATENT DOCUMENTS

| | | |
|---|---|---|
| 4,523,759 A | 6/1985 | Igarashi |
| 4,928,972 A | 5/1990 | Nakanishi et al. |

(Continued)

FOREIGN PATENT DOCUMENTS

| | | |
|---|---|---|
| JP | HO 4241883 | 8/1992 |
| JP | 2001-231896 | 8/2001 |

(Continued)

OTHER PUBLICATIONS

Japanese Office Action for JP Application No. 2018-005502 dated Oct. 25, 2021 (English Translation), 20 pages.

*Primary Examiner* — John E Simms, Jr.

(57) ABSTRACT

A golf club head having a damping treatment, such as a viscoelastic polymer, is disclosed. The viscoelastic polymer may be in contact with the rear surface of a striking face of the golf club head. The viscoelastic polymer may have a tangent of delta peak temperature between −70 degrees Celsius and −20 degrees Celsius at a 1 Hz frequency. An elastic modulus (E), in megapascals (MPa), of the viscoelastic polymer has a relationship to a striking face thickness (t), in millimeters (mm), defined by $\hat{E} \leq -14\hat{t}+305$. The elastic modulus (E), in megapascals (MPa), of the viscoelastic polymer has a relationship to an effective stiffness (S) of the striking face, in gigapascals per meter (GPa/m), defined by $\hat{E} \leq -1.16\hat{S}+258.33$. The viscoelastic polymer may cover a portion of the rear surface of the striking face or may substantially fill a cavity of the golf club head.

16 Claims, 10 Drawing Sheets

Related U.S. Application Data continuation of application No. 15/408,000, filed on Jan. 17, 2017, now Pat. No. 10,099,103.

(58) Field of Classification Search
USPC ..... 473/324, 329, 332
See application file for complete search history.

(56) References Cited

U.S. PATENT DOCUMENTS

| | | | | |
|---|---|---|---|---|
| 5,184,823 | A | 2/1993 | Desboilles et al. | |
| 5,290,036 | A | 3/1994 | Fenton | |
| 5,348,302 | A | 9/1994 | Sasamoto et al. | |
| 5,447,311 | A | 9/1995 | Voillaz et al. | |
| 5,766,092 | A | 6/1998 | Mimeur et al. | |
| 5,772,572 | A | 6/1998 | Koch et al. | |
| 6,045,456 | A | 4/2000 | Best | |
| 6,635,327 | B2 | 10/2003 | Ohira | |
| 6,991,559 | B2 | 1/2006 | Yabu | |
| 7,112,147 | B2 | 9/2006 | Solheim | |
| 7,125,343 | B2 | 10/2006 | Imamoto | |
| 7,126,339 | B2 | 10/2006 | Nagai et al. | |
| 7,182,698 | B2 | 2/2007 | Tseng | |
| 7,273,418 | B2 | 9/2007 | Gilbert | |
| 7,281,991 | B2 | 10/2007 | Gilbert et al. | |
| 7,591,735 | B2 | 9/2009 | Matsunaga | |
| 7,611,423 | B2 | 11/2009 | Matsunaga | |
| 7,744,486 | B2 | 6/2010 | Hou et al. | |
| 7,819,757 | B2 | 10/2010 | Soracco | |
| 7,906,594 | B2 | 3/2011 | Muck | |
| 8,663,028 | B2 | 3/2014 | Nakano | |
| 8,814,725 | B2 | 8/2014 | Wahl et al. | |
| 8,979,668 | B2 | 3/2015 | Nakamura | |
| 9,039,543 | B2 | 5/2015 | Mizutani | |
| 9,168,435 | B1 | 10/2015 | Boggs | |
| 9,265,995 | B2 | 2/2016 | Wahl | |
| 9,345,938 | B2 | 5/2016 | Parsons | |
| 9,878,220 | B2 | 1/2018 | Parsons et al. | |
| 10,099,103 | B2 | 10/2018 | Golden et al. | |
| 2002/0059835 | A1 | 5/2002 | Miyazaki | |
| 2005/0272522 | A1 | 12/2005 | Chen et al. | |
| 2007/0111588 | A1 | 5/2007 | Weinberger | |
| 2007/0129165 | A1* | 6/2007 | Matsunaga | A63B 53/047 473/345 |
| 2009/0118033 | A1 | 5/2009 | Nakamura | |
| 2009/0191979 | A1* | 7/2009 | Hou | A63B 53/047 473/332 |
| 2011/0028240 | A1* | 2/2011 | Wahl | B23P 17/04 473/346 |
| 2012/0172144 | A1 | 7/2012 | Mazutani | |
| 2012/2017214 | | 5/2013 | Mazutani | |
| 2013/0109500 | A1 | 5/2013 | Boyd | |
| 2013/0206311 | A1 | 8/2013 | Fudemoto | |
| 2013/0318772 | A1* | 12/2013 | Wahl | A63B 60/00 29/530 |
| 2015/0031471 | A1 | 1/2015 | Su | |
| 2018/0200593 | A1* | 7/2018 | Golden | A63B 60/54 |
| 2018/0339207 | A1* | 11/2018 | Hebreo | A63B 53/047 |
| 2019/0255397 | A1* | 8/2019 | Hebreo | A63B 53/047 |
| 2020/0353325 | A1* | 11/2020 | Taylor | A63B 53/0475 |

FOREIGN PATENT DOCUMENTS

| | | |
|---|---|---|
| JP | 3125633 | 9/2006 |
| JP | 2007-151826 | 6/2007 |
| JP | 2009-112585 | 5/2009 |
| JP | 2012-139404 | 7/2012 |
| JP | 2015-181769 | 10/2015 |

* cited by examiner

GOLF CLUB HAVING DAMPING TREATMENTS FOR IMPROVED IMPACT ACOUSTICS AND BALL SPEED

CROSS-REFERENCE TO RELATED APPLICATIONS

This application is a continuation of, and claims priority to, U.S. patent application Ser. No. 16/117,777, now U.S. Pat. No. 10,716,985, filed on Aug. 30, 2018, titled "GOLF CLUB HAVING DAMPING TREATMENTS FOR IMPROVED IMPACT ACOUSTICS AND BALL SPEED, which is a continuation of, and claims priority to, U.S. patent application Ser. No. 15/408,000, now U.S. patent Ser. No. 10/099,103, filed on Jan. 17, 2017, titled "GOLF CLUB HAVING DAMPING TREATMENTS FOR IMPROVED IMPACT ACOUSTICS AND BALL SPEED", which applications are incorporated herein by reference in their entirety.

BACKGROUND

When a golf club strikes a golf ball, it emits sound due to the vibration of the components of the golf club head. As golf clubs are manufactured with progressively thinner striking faces, the sounds emitted from those golf club heads may become more displeasing to a golfer when he or she strikes a golf ball. For instance, the thinner striking faces may produce higher pitched sounds that may not be traditionally associated with a solid ball strike. While attaching rigid support structures to the striking face has been found to partially improved sound emission, those rigid structures may cause a loss of ball speed resulting from a strike.

SUMMARY

In one aspect, the technology relates to a golf club head including a striking face and a viscoelastic polymer in contact with a rear surface of the striking face. The viscoelastic polymer has a tangent of delta peak temperature between −70 degrees Celsius and −20 degrees Celsius at 1 Hz. In an example, the viscoelastic polymer has a tangent of delta peak temperature between 20 degrees Celsius and 50 degrees Celsius at 6 kHz. In another example, an elastic modulus (E), in megapascals (MPa), of the viscoelastic polymer has a relationship to a striking face thickness (t), in millimeters (mm), defined by $\hat{E} \leq 14\hat{t}+305$, wherein $\hat{E}$ is a unitless value equal to E/1 MPa and $\hat{t}$ is a unitless value equal to t/1 mm. In yet another example, the relationship between E and t is further defined by $\hat{E} \leq -33.24\hat{t}+63.24$. In still yet another example, an elastic modulus (E), in megapascals (MPa), of the viscoelastic polymer has a relationship to an effective stiffness (S) of the striking face, in gigapascals per meter (GPa/m), defined by $\hat{E} \leq -1.16\hat{S}+258.33$, wherein $\hat{E}$ is a unitless value equal to E/1 MPa and $\hat{S}$ is a unitless value equal to S/1 GPa/m.

In another example, the relationship between E and S is further defined by $\hat{E} \geq -0.335\hat{S}+63.33$. In yet another example, the effective stiffness S is defined as $$S = \frac{E_{face} t}{A},$$

wherein $E_{face}$ is the elastic modulus of the material of the striking face and A is an area of the striking face. In still yet another example, the golf club head displays a coefficient of restitution (COR) above 0.80. In another example, the viscoelastic polymer has a thickness between 1 mm and 15 mm. In yet another example, the viscoelastic polymer covers more than 50% of the rear surface of the striking face. In still yet another example, the viscoelastic polymer substantially fills a cavity of the golf club head. In another example, the polymer comprises at least one of butyl rubbers, butyl rubber ionomers, polyurethanes, polyureas, silicones, acrylate, methacrylates, foamed polymers, epoxies, styrene block copolymers, polybutadiene, nitrile rubber, thermoplastic vulcanizates, and thermoplastic elastomers. In yet another example, wherein the thickness (t) is one of an average thickness of the striking face and a maximum thickness of the striking face.

In another aspect, the technology relates to a golf club head including a striking face having a thickness (t) and a viscoelastic polymer, having an elastic modulus (E), in contact with a rear surface of the striking face. The elastic modulus (E), in megapascals (MPa), of the viscoelastic polymer has a relationship to the striking face thickness (t), in millimeters (mm), defined by $\hat{E} \leq -14\hat{t}+305$, wherein $\hat{E}$ is a unitless value equal to E/1 MPa and $\hat{t}$ is a unitless value equal to t/1 mm. In an example, the relationship between E and t is further defined by $\hat{E} \geq -33.24\hat{t}+63.24$. In another example, the elastic modulus (E), in megapascals (MPa), of the viscoelastic polymer has a relationship to an effective stiffness (S) of the striking face, in gigapascals per meter (GPa/m), defined by $\hat{E} \leq -1.16\hat{S}+258.33$, wherein $\hat{E}$ is a unitless value equal to E/1 MPa and $\hat{S}$ is a unitless value equal to S/1 GPa/m. In yet another example, the relationship between E and S is further defined by $\hat{E} \geq -0.335\hat{S}+63.33$. In still yet another example, the viscoelastic polymer has a tangent of delta peak temperature between −10 degrees Celsius and 40 degrees Celsius at 1 kHz.

In another aspect, the technology relates to golf club head including a striking face having an effective stiffness (S) and a viscoelastic polymer, having an elastic modulus (E), in contact with a rear surface of the striking face. The elastic modulus (E), in megapascals (MPa), of the viscoelastic polymer has a relationship to the effective stiffness (S) of the striking face, in gigapascals per meter (GPa/m), defined by $\hat{E} \leq -1.16\hat{S}+258.33$, wherein $\hat{E}$ is a unitless value equal to E/1 MPa and $\hat{S}$ is a unitless value equal to S/1 GPa/m. In an example, the relationship between E and S is further defined by $\hat{E} \geq -0.33\hat{S}+63.33$.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

Non-limiting and non-exhaustive examples are described with reference to the following Figures.

DETAILED DESCRIPTION

The technologies described herein contemplate utilizing a treatment to a rear surface of a striking face to absorb or reduce undesired sound emissions resulting from a ball strike while still substantially retaining the resultant ball speed. As striking faces have become progressively thinner in modern golf clubs, they emit sound frequencies within ranges that are considered undesirable by some golfers. Further, the thinner faces often require some type of additional rigid support structure attached to the striking face to provide additional support. The present technology incorporates a treatment, such as a viscoelastic material, to the rear surface of the striking face of the golf club. The viscoelastic material is developed to absorb undesirable frequencies emitted by the striking face upon striking a golf ball. Additionally, the viscoelastic material does not significantly inhibit the flex of the striking face upon striking a golf ball. Thus, the ball speed of the struck golf ball is substantially preserved. In some examples, the viscoelastic material also provides additional support to the striking face, increasing durability of the golf club head.

Figure 1A:
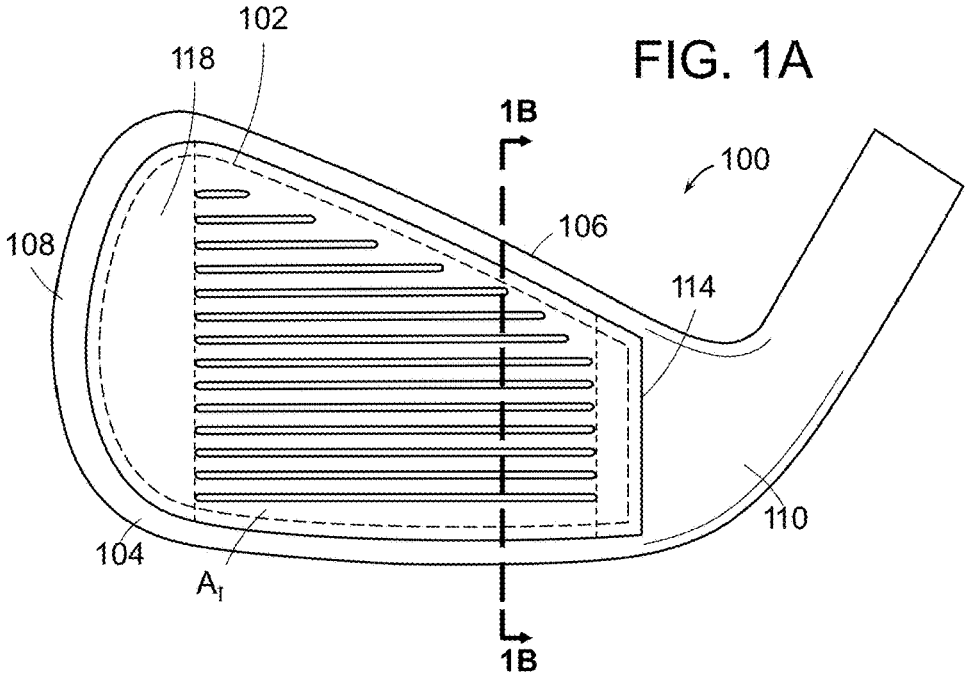
FIG. 1A depicts a front view of an iron-type golf club head having a viscoelastic polymer in contact with the rear surface of a striking face.
Figure 1B:
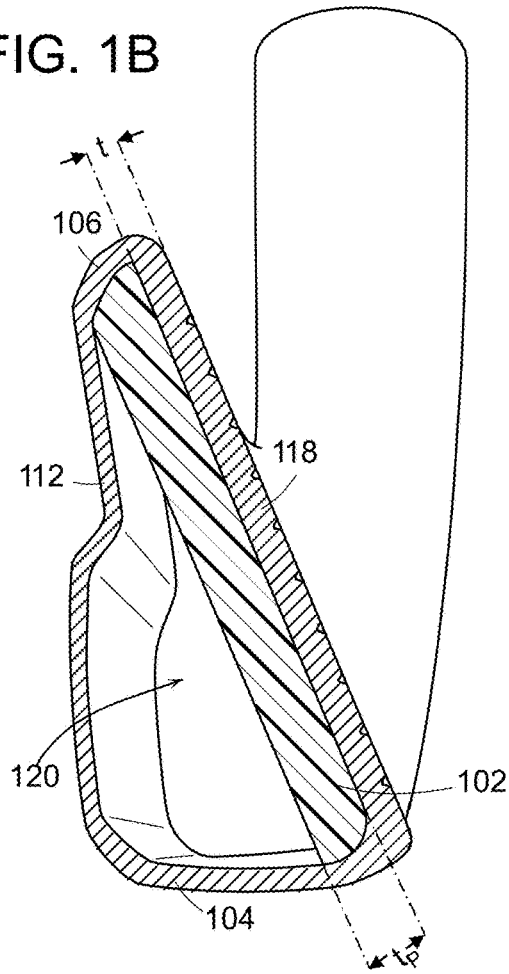
FIG. 1B depicts a right section view of the golf club head depicted in FIG. 1A.

FIG. 1A depicts a front view of an iron-type golf club head 100 having a viscoelastic polymer 102 in contact with the rear surface of a striking face 118. FIG. 1B depicts a right section view of the golf club head depicted in FIG. 1A. FIGS. 1A-1B are described concurrently. The golf club head 100 includes a sole portion 104, a topline 106, a toe portion 108, a heel portion 110 having a heel edge 114, and a back portion 112. A cavity 120 is defined by the striking face 118, the sole portion 104, the topline 106, the toe portion 108, the heel portion 110, and the back portion 112. The viscoelastic polymer 102 is in contact with the rear surface of the striking face 118 and the viscoelastic polymer 102 has a thickness $t_P$. In some examples, the thickness $t_P$ may be the average thickness of the viscoelastic polymer 102. In other examples the thickness $t_P$ may be the maximum thickness of the viscoelastic polymer 102. In examples, the thickness $t_P$ of the viscoelastic polymer 102 may be about 13 mm, or greater. The thickness $t_P$ may also be between 1 mm-20 mm, 3-18 mm, 8-15 mm, or 12-14 mm in other examples. The thickness $t_P$ may also be less than 1 mm in some examples where the viscoelastic polymer 102 is applied as a coating to the rear surface of the striking face 118. The viscoelastic polymer 102 may cover more than 50% of the rear surface of the striking face 118, and in other examples, a smaller amount of the surface area of the rear surface is covered by the viscoelastic polymer 102. In yet other examples, the viscoelastic polymer 102 may fill substantially all of the cavity 120. The viscoelastic polymer 102 maybe attached to the rear surface of the striking face 118 via an adhesive or other fastening techniques. In some examples, the characteristics of the viscoelastic polymer 112 may result in it directly adhering to the rear surface of the striking face 118.

The striking face 118 has a thickness t and an impact area $A_I$. The thickness t may be about 1.5 mm. In some examples the thickness t of the striking face may be between 1.2-1.7 mm, 1.4-1.9 mm, or 1.7-2.2 mm, or greater. The United States Golf Association (USGA) defines the impact area $A_I$ for an iron, such as golf club head 100, as the part of the club where a face treatment has been applied (e.g., grooves, sandblasting, etc.) or the central strip down the middle of the club face having a width of 1.68 inches (42.67 mm), whichever is greater. For clubs with inserts in the face, the boundary of the impact area is defined by the boundary of the insert, as long as any markings outside the boundary do not encroach the impact area by more than 0.25 inches (6.35 mm) and/or are not designed to influence the movement of the ball, if the insert itself extends to at least 0.84 inches (21.34 mm) on either side of the center line of the face and to within at least 0.2 inches (5.08 mm) of the top line and leading edge of the face.

Figure 2A:
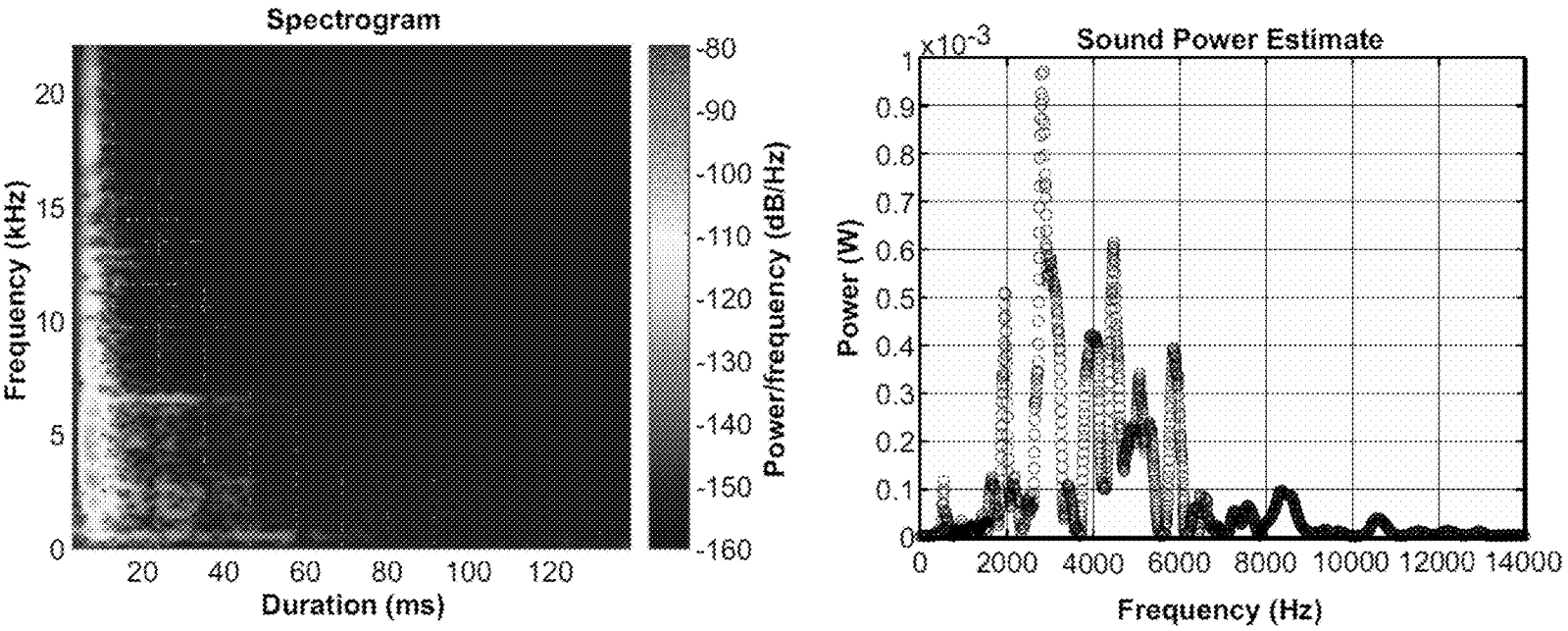
FIG. 2A depicts an example of an audio spectrogram and sound power estimate for a ball strike by a club head without utilizing a viscoelastic polymer.

FIG. 2A depicts an example of an audio spectrogram and a sound power estimate obtained from a ball strike by a club head without a viscoelastic polymer of the types described herein. In general, iron-type golf club heads that emit high frequency sound emissions that have either strong power characteristics and/or long durations are often undesirable. As can be seen from the spectrogram and sound power estimate in FIG. 2A, multiple frequencies are produced as a result of the ball strike. A strong mode can be seen, however, at approximately 6 kHz that has a duration of over 40 milliseconds and a power estimate of approximately 0.4 milliwatts. That frequency of 6 kHz is perceived as a generally high pitch to humans and is an undesirable sound produced by an iron-type golf club head, particularly when the sound continues to be emitted for such a long duration.

Figure 2B:
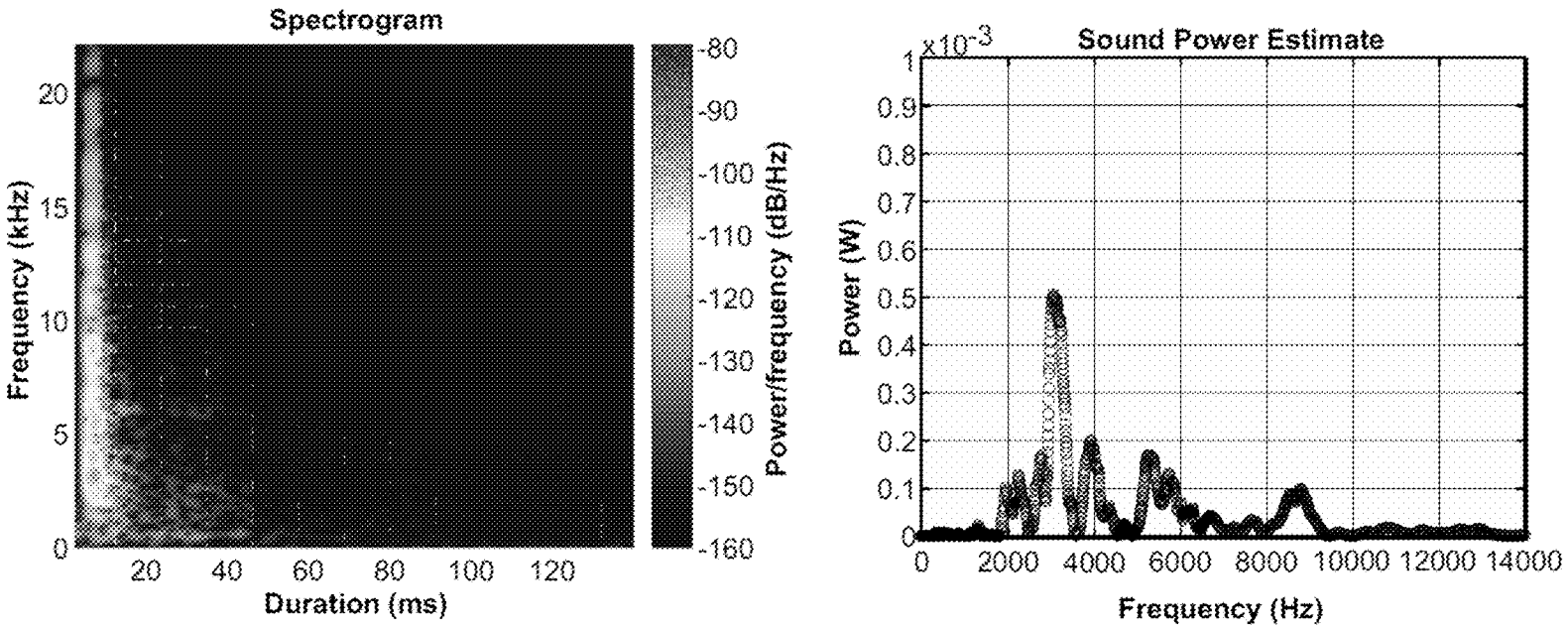
FIG. 2B depicts an example of an audio spectrogram and sound power estimate for a ball strike by a club head utilizing the viscoelastic polymer.

In contrast, FIG. 2B depicts an example of an audio spectrogram and a sound power estimate for a ball strike by a club head with a viscoelastic polymer of the types described herein, such as a club head similar to golf club head 100 depicted in FIGS. 1A-1B. As can be seen from the spectrogram and the sound power estimate in FIG. 2B, the sound production at higher frequencies is reduced. For example, the strong mode at approximately 6 kHz seen in FIG. 2A has been substantially reduced. Other high pitch frequencies are similarly reduced by including the viscoelastic polymer.

A variety of different viscoelastic polymers may be implemented in the present technology. For instance, the polymer may comprise at least one of butyl rubbers, butyl rubber ionomers, polyurethanes, polyureas, silicones, acrylate, methacrylates, foamed polymers, epoxies, styrene block copolymers, polybutadiene, nitrile rubber, thermoplastic vulcanizates, and thermoplastic elastomers. Suitable materials may also include polyether esters such as a HYTREL material (available from the E.I. du Pont de Nemours and Company of Wilmington, Del.) or a RITEFLEX material (available from the Celanese Corporation of Irving, Tex.); polyether amides such as a PEBAX material (available from Arkema of Colombes, France); polyurethanes such as a ELASTOLLAN material (available from the BASF Corporation of Wyandotte, Mich.), a PANDEX material (available from the DIC Corporation of Tokyo, Japan), or an ESTANE material (available from The Lubrizol Corporation of Wickliffe, Ohio); polyacrylates such as a HYTEMP material (available from the Zeon Corporation of Tokyo, Japan); polysiloxanes such as materials from NuSil Technology, LLC of Carpinteria, Calif. or an ELASTOSIL material (available from Wacker Chemie AG of Munich, Germany), ethylene-alpha olefin copolymers such as an AMPLIFY material (available from The Dow Chemical Company of Midland, Mich.) or an ENGAGE material (available from The Dow Chemical Company of Midland, Mich.); plasticized PVC such as APEX Flexible PVC (available from the Teknor Apex Company of Pawtucket, R.I.); and thermoplastic vulcanizates such as a SANTOPRENE material (available from the ExxonMobil Chemical Company of Spring, Tex.). However, the particular viscoelastic polymer utilized or synthesized should generally be able to absorb frequencies within undesirable frequency ranges. The selection or synthesis of the polymer may be based on the particular frequencies emitted by golf club head without the viscoelastic polymer. For instance, from the audio spectrogram depicted in FIG. 2A obtained from a golf club head without a viscoelastic polymer, the ringing at about 6 kHz may be identified as an undesirable frequency. Based on that identification, a viscoelastic polymer may be selected or synthesized such that it has a maximum energy absorption at about 6 kHz, as discussed further below.

A viscoelastic material can generally be described as having both viscous and elastic properties during deformation. For instance, when undergoing deformation, a portion of the energy is stored in the viscoelastic material and another portion of the energy is dissipated, or lost, as heat. Accordingly, viscoelastic behavior may be described by its dynamic, or complex, moduli in the following two equations:

$$E^*=E'+iE'' \quad (1)$$

In Equation (1), the E* is complex Young's modulus, E' is the storage modulus representing the stored energy, and E" is the loss modulus representing the energy dissipated from the system. A viscoelastic material having E"/E'<1 exhibits predominately elastic behavior and a viscoelastic material having or E"/E'>1, exhibits predominately viscous behavior and a viscoelastic material. Selection or synthesis of polymers may take into account the varying storage and loss moduli for the desired polymer such that it absorbs undesired frequencies without significantly inhibiting face deflection.

Related properties of viscoelastic materials, e.g., the glass transition temperature $T_g$ and the tangent of delta (tan δ), may also be used in selecting or synthesizing a polymer that more optimally absorbs energy at a particular frequency. The glass transition temperature $T_g$ is the point at which a material transitions from a glass-like rigid solid to a more flexible, compliant, or rubbery state. The tan δ is a measure of a material's ability to absorb vibrations and is the ratio between the storage modulus E" and Young's modulus E'. The tangent of delta can be represented by the following equation:

$$\tan\delta = \frac{E''}{E'} \quad (2)$$

Figure 3:
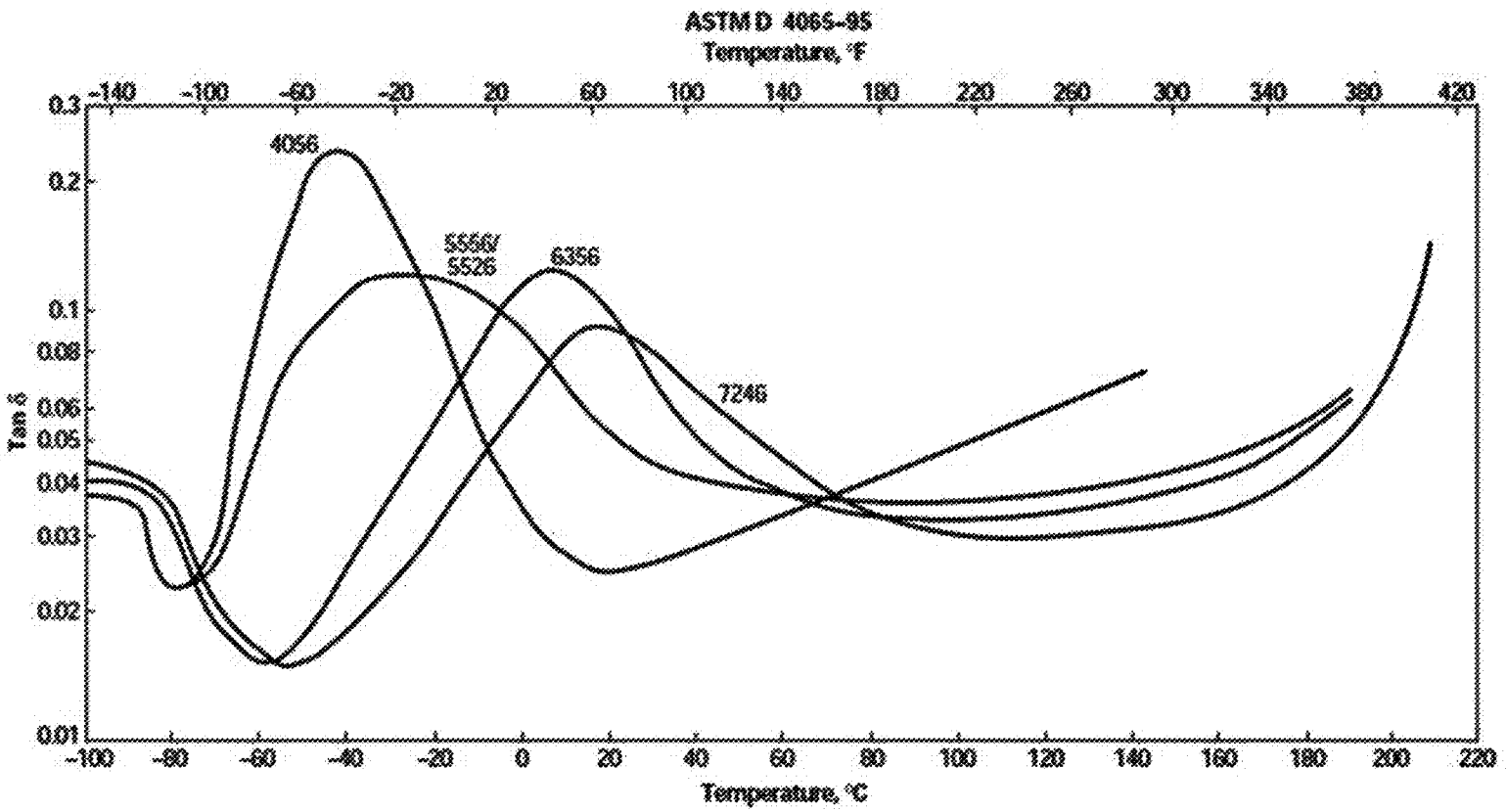
FIG. 3 depicts a sample tangent of delta plot.

The tan δ value for a particular polymer changes with temperature and is also dependent on the frequency of vibrations being absorbed. The glass transition temperature $T_g$ and the tan δ properties for a particular material can be determined using Dynamic Mechanical Analysis (DMA), among other techniques, as will be recognized by those having skill in the art. A sample tan δ plot is depicted in FIG. 3. The plot in FIG. 3 is for the HYTREL material available from the E.I. du Pont de Nemours and Company of Wilmington, Del. In FIG. 3, the tan δ curve is shown for several grades of the HYTREL material at 1 Hz frequency.

The viscoelastic polymer utilized in the present technology has a peak tan δ at temperature range for which a golf club would normally be used (approximately 19-50 degrees Celsius) for a frequency that is desired to be eliminated. In some examples, the peak tan δ occurs at room temperature (approximately 19-23 degrees Celsius). For the example golf club head producing the audio spectrogram depicted in FIG. 2A, the viscoelastic polymer to be incorporated into that golf club is selected or synthesized to have a peak tan δ at a temperature between 19-23 degrees Celsius at about 6 kHz. Combinations of polymers to form a copolymer may be used to "tune" the peak tan δ temperature of the resultant copolymer to match the desired properties. In some examples, materials displaying a peak tan δ between −70 and −20 degrees Celsius at 1 Hz provide suitable energy absorption and deflection characteristics. In particular, a viscoelastic polymer material displaying a peak tan δ at about −50 degrees Celsius at 1 Hz is a suitable viscoelastic material for the present technology. A viscoelastic polymer material displaying a peak tan δ between −10 to 40 degrees Celsius at 1 kHz or 10 kHz may also be a suitable viscoelastic material for the present technology.

In an example, the peak tan δ is greater than 0.15. In some examples, a wider curve around the tan δ is desirable. In such examples, the viscoelastic polymer is able to absorb a broader spectrum of frequencies at larger range of temperatures.

For copolymers, the glass transition temperature ($T_g$) may be predicted or estimated based on different equations, such as the Fox Equation and the Gordon-Taylor Equation. The Fox Equation is as follows: $1/T_{g,mix} \approx \Sigma_i \omega_i / T_{g,i}$ where here $T_{g,mix}$ and $T_{g,i}$ are the glass transition temperature in Kelvin of the mixture and of the components, and $\omega_i$ is the mass fraction of component i. The Gordon-Taylor Equation is as follows: $T_{g,mix} \approx \Sigma_i[\omega_i \cdot \Delta C_{pi} T_{g,i}]/\Sigma_i[\omega_i \cdot \Delta C_{pi}]$, where $\Delta C_{pi}$ is the change of the heat capacity when crossing from the glass to the rubber state for the component i. A combination of copolymers is generally acceptable for use in the present technology where the predicted glass transition temperature from either the Fox Equation or the Gordon-Taylor Equation is within 15 degrees Celsius or Kelvin of the desired peak tan δ as discussed above. For example, a copolymer material may be considered generally acceptable where at least one of the following inequalities are satisfied $T_{Fox}-15 \leq T_{tan\,\delta} \leq T_{Fox}+15$ and $T_{GT}15 \leq T_{tan\,\delta} \leq T_{GT}+15$, where $T_{Fox}$ is predicted glass transition temperature in Kelvin from the Fox Equation, $T_{GT}$ is the predicted glass transition temperature in Kelvin form the Gordon-Taylor Equation, and $T_{tan\,\delta}$ is the desired peak tan δ temperature in Kelvin.

Figure 4A:
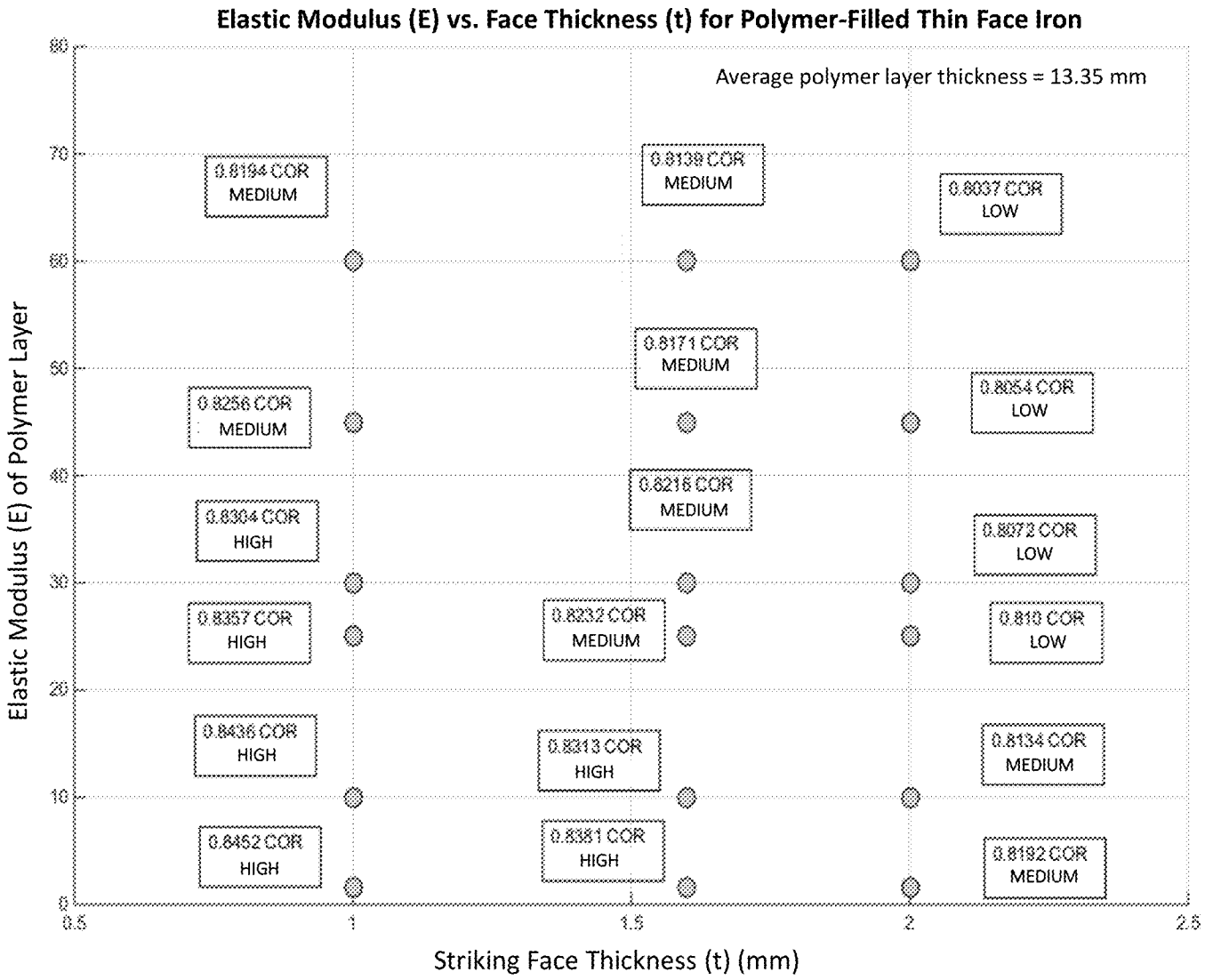
FIG. 4A depicts a plot of elastic modulus of a viscoelastic polymer versus a thickness of a striking face for a thin face iron.

The thickness (t) of the striking face and the elastic modulus (E) of the viscoelastic polymer may also be selected to allow energy absorption and maintain more optimal ball speed characteristics upon the golf club striking a golf ball. FIG. 4A depicts a plot of elastic modulus (E) of the viscoelastic polymer layer versus the thickness (t) of a striking face for a thin face iron. The y-axis of the plot represents the elastic modulus (E) for the viscoelastic polymer in units of megapascals, and the x-axis of the plot represents the thickness (t) of the striking face in millimeters. Multiple points are included in the plot, and each point on the plot represents an example combination for a golf club having the corresponding face thickness (t) and a viscoelastic polymer having the corresponding elastic modulus (E). For each of the example points in the plot, a box is displayed providing a coefficient of restitution (COR) and a maximum stress for the striking face for the particular example point. The maximum stress is represented as "LOW," "MEDIUM", and "HIGH." Stresses within the medium range are generally more optimal than stresses within the high range and allow for increased durability of the golf club. The plot was generated through finite element modeling (FEM) based on a three-iron chassis with an average polymer layer thickness of 13.35 mm.

Figure 4B:
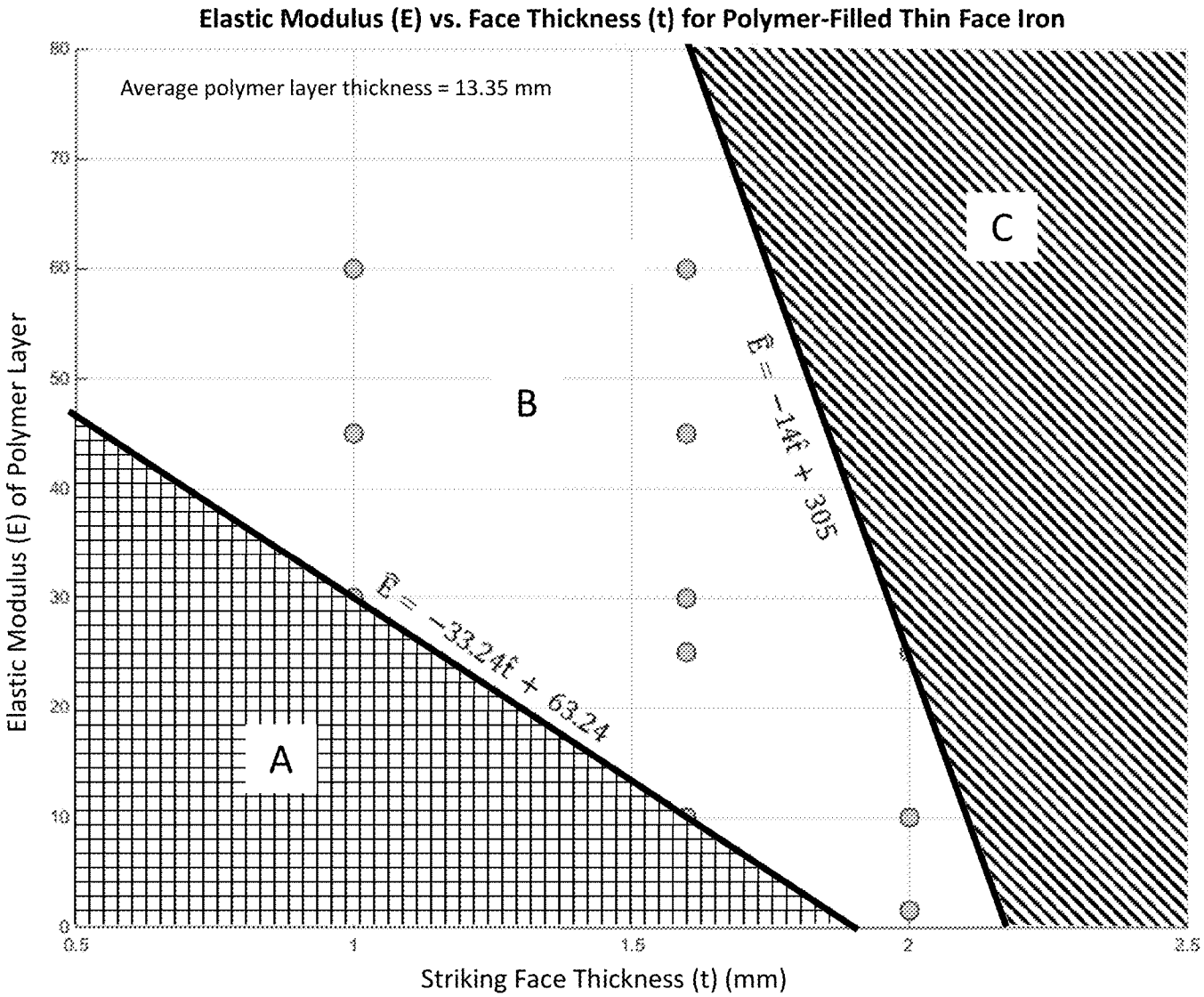
FIGS. 4B-4C depict annotated versions of the plot shown in FIG. 4A.

Some combinations of elastic modulus (E) and striking face thickness (t), however, may be unsuitable for golf clubs because either the golf club becomes too stiff (resulting in poor COR and low ball speed performance) or the stress becomes too high (thus reducing the durability of the golf club to undesirable levels). FIG. 4B depicts an annotated version of the plot depicted in FIG. 4A. The annotated plot in FIG. 4B identifies three regions: Region A, Region B, and Region C. Combinations of face thicknesses and elastic moduli in Region A may be undesirable because those combinations result in a golf club head that incurs high stress values that result in poor durability for the golf club head. For instance, for the combination of an elastic modulus of 10 MPa and a striking face thickness of 1 mm, the golf club incurs a high stress value (as shown in FIG. 4A), which would result in low durability for the golf club head. Region A is bounded on the axes and by the line $\hat{E}=-63.24$, wherein $\hat{E}$ is a unitless value equal to E/1 MPa and $\hat{t}$ is a unitless value equal to t/1 mm. Thus, the values of E and t in Region A include any combination of values greater than zero satisfying the inequality $\hat{E}\leq-33.24\hat{t}+63.24$.

In contrast, combinations of face thicknesses and elastic moduli in Region C may be unacceptable because the golf club face becomes too stiff resulting in poor COR and low ball speed performance. For instance, for the combination of an elastic modulus of 60 MPa and a face thickness of 2 mm, the golf club has COR of 0.8037 (as shown in FIG. 4A), which may be too low for some golf club constructions. Region C is bounded on the lower end by the line $\hat{E}=-14\hat{t}+305$. Thus, the values of E and t in Region C are any a combination of values greater than zero satisfying the inequality $\hat{E}\geq-14\hat{t}+305$. Depending on the particular golf club construction there may be circumstances where combinations that fall within Regions A or C may be acceptable.

Combinations of face thicknesses and elastic moduli in Region B provide for more optimal durability and COR when incorporated into a golf club head. For instance, for the combination of an elastic modulus of 30 MPa and a striking face thickness of 1.6 mm, the golf club face incurs stresses generally within the medium range and a COR of up to 0.8216 (as shown in FIG. 4A). Such a combination results in a golf club head that has strong durability qualities and high ball speed performance. Region B is bounded on lower end by the line $\hat{E}=-33.24\hat{t}+63.24$ and on the upper end by the line $\hat{E}=-14\hat{t}+305$. Accordingly, the values of E and t in Region B are any combination of values greater than zero satisfying the inequalities $\hat{E}\leq-14\hat{t}+305$ and $\hat{E}\geq-33.24\hat{t}+63.24$.

Figure 4C:
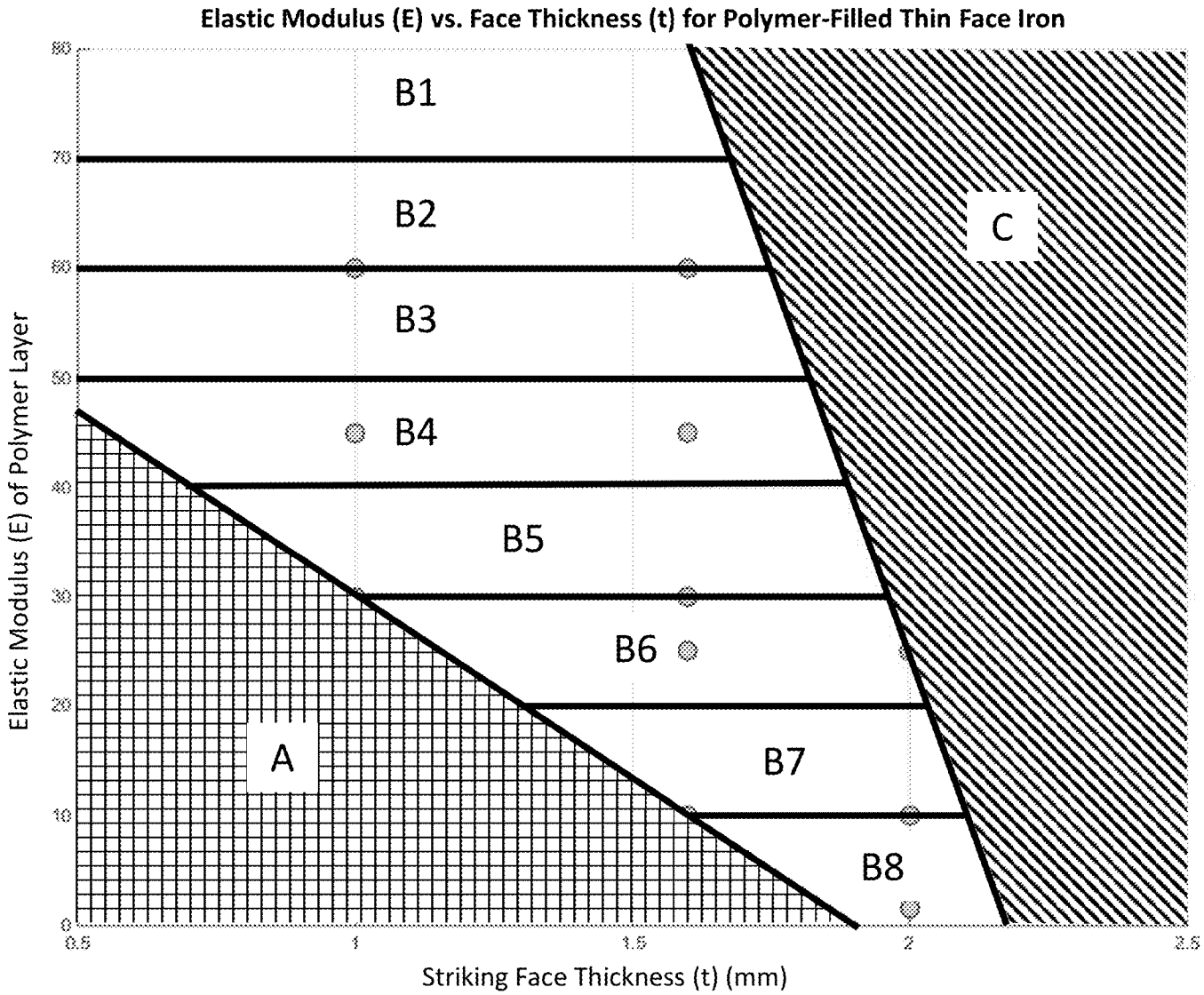

FIG. 4C depicts another annotated version of the plot depicted in FIGS. 4A-4B. The plot depicted in FIG. 4C illustrates further Sub Regions B1-B8 of Region B. The particular sub regions may have uses in different golf club head technologies and applications. For instance, in golf club heads where additional support behind the striking face is desired, Sub Regions B1-B4 may be desirable, with Sub Region B1 providing for viscoelastic polymers having the highest elastic modulus (E). Sub Regions B5-B8 may be more suitable for golf club heads having striking faces requiring less support from the viscoelastic polymer, with least amount of support occurring in Sub Region B8. Sub Region B1 includes any combination of elastic modulus and face thickness satisfying the inequalities $\hat{E}\leq-14\hat{t}+305$ and $\hat{E}\geq70$. Sub Region B2 includes any combination of elastic modulus and face thickness satisfying the inequalities $\hat{E}\leq-14\hat{t}+305$; $\hat{E}\geq60$; and $\hat{E}<70$. Sub Region B3 includes any combination of elastic modulus and face thickness satisfying the inequalities $\hat{E}\leq-14\hat{t}+305$; $\hat{E}\geq50$; and $\hat{E}<60$. Sub Region B4 includes any combination of elastic modulus and face thickness satisfying the inequalities $\hat{E}\leq-14\hat{t}+305$; $\hat{E}\geq-33.24\hat{t}+63.24$; $\hat{E}\geq40$; and $\hat{E}<50$. Sub Region B5 includes any combination of elastic modulus and face thickness satisfying the inequalities $\hat{E}\leq-14\hat{t}+305$; $\hat{E}\geq-33.24\hat{t}+63.24$; $\hat{E}\geq30$; and $\hat{E}<40$. Sub Region B6 includes any combination of elastic modulus and face thickness satisfying the inequalities $\hat{E}\leq-14\hat{t}+305$; $\hat{E}\geq-33.24\hat{t}+63.24$; $\hat{E}\geq20$; and $\hat{E}<30$. Sub Region B7 includes any combination of elastic modulus and face thickness satisfying the inequalities $\hat{E}\leq-14\hat{t}+305$; $\hat{E}\geq-33.24\hat{t}+63.24$; $\hat{E}\geq10$; and $\hat{E}<20$. Sub Region B8 includes any combination of elastic modulus and face thickness satisfying the inequalities $\hat{E}\leq-14\hat{t}+305$; $\hat{E}\geq-33.24\hat{t}+63.24$; and $\hat{E}<10$.

In some examples, the elastic modulus and striking face thickness are acceptable when the values for the elastic modulus and striking face thickness satisfy certain of one or more of the following inequalities: $\hat{E}*\hat{t}\leq90$; $\hat{t}\leq2$; and $10\geq\hat{E}\leq75$. Such examples of golf clubs having a face thickness and elastic modulus satisfying those inequalities display a COR and durability requirements that are generally acceptable for many applications.

The elastic modulus (E) of the viscoelastic polymer and the effective stiffness (S) of the striking face may also be selected to allow energy absorption and maintain more optimal ball speed characteristics upon the golf club striking a golf ball. The effective stiffness (S) is defined as $$S=\frac{E_{face}t}{A},$$

wherein $E_{face}$ is the elastic modulus of the material of the striking face, t is the striking face thickness, and A is an area of the striking face. If the striking face is a variable thickness face, the striking face thickness (t) may either be the maximum striking face thickness ($t_{max}$) or the average striking face thickness ($t_{average}$). The area A may be defined as the impact area $A_I$ discussed above with reference to FIGS. 1A-1B.

Figure 5A:
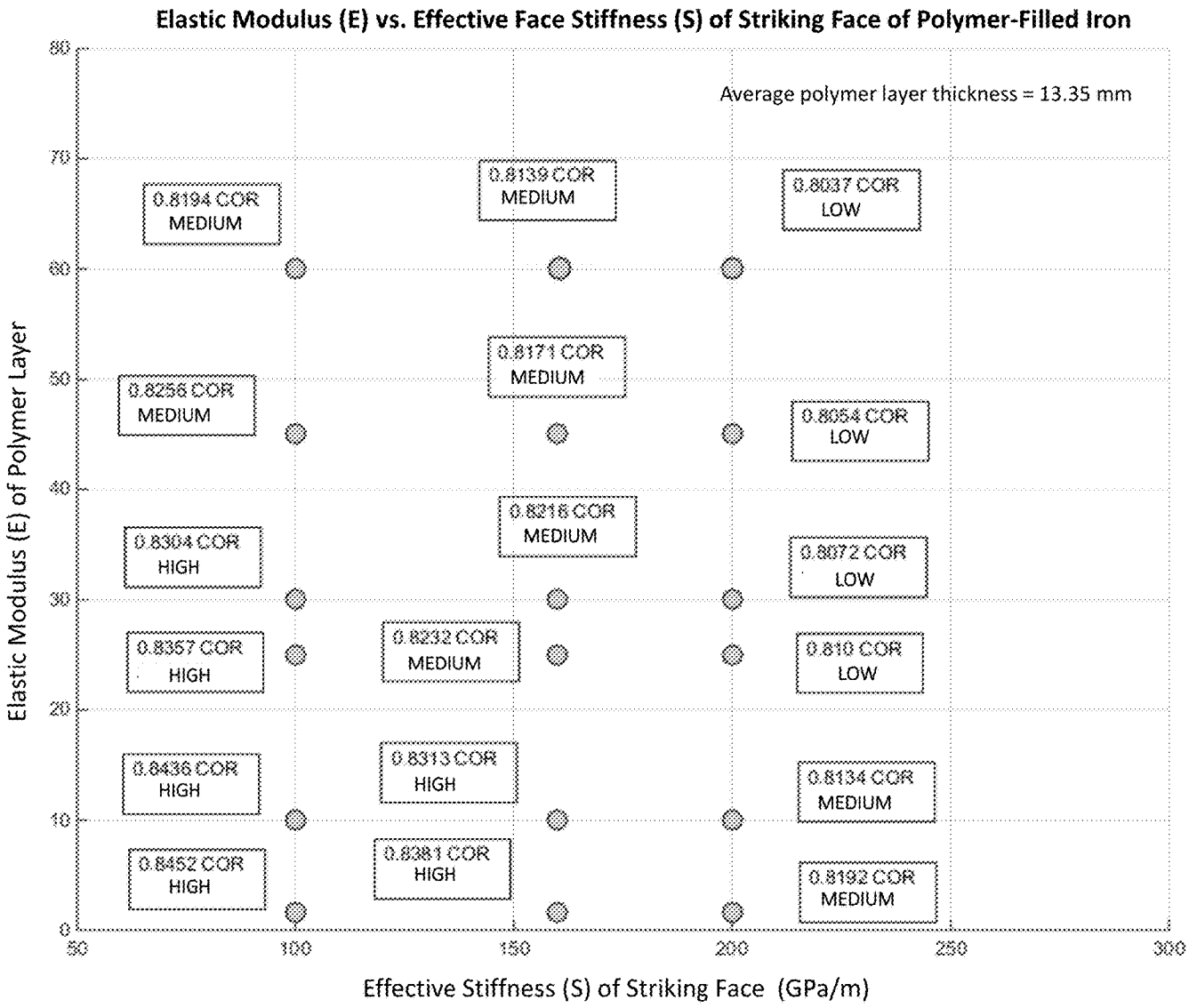
FIG. 5A depicts a plot of elastic modulus of a viscoelastic polymer versus an effective stiffness of the striking face for a golf club head having a polymer layer.

FIG. 5A depicts a plot of elastic modulus (E) of the viscoelastic polymer versus the effective stiffness (S) of the striking face an iron having a polymer layer. The y-axis of the plot represents the elastic modulus for the viscoelastic polymer in units of megapascals (MPa), and the x-axis of the plot represents the effective stiffness (S) of the striking face in units of gigapascals per meter (GPa/m). Multiple points are included in the plot, and each point on the plot represents an example combination for a golf club having the corresponding effective face stiffness (S) and a viscoelastic polymer having the corresponding elastic modulus (E). For each of the example points in the plot, a box is displayed providing a coefficient of restitution (COR) and a maximum stress for the striking face for the particular example point. The maximum stress is represented as "LOW," "MEDIUM", and "HIGH." Stresses within the medium range are generally more optimal than stresses within the high range and allow for increased durability of the golf club. The plot was generated through finite element modeling (FEM) with an average polymer layer thickness of 13.35 mm.

Figure 5B:
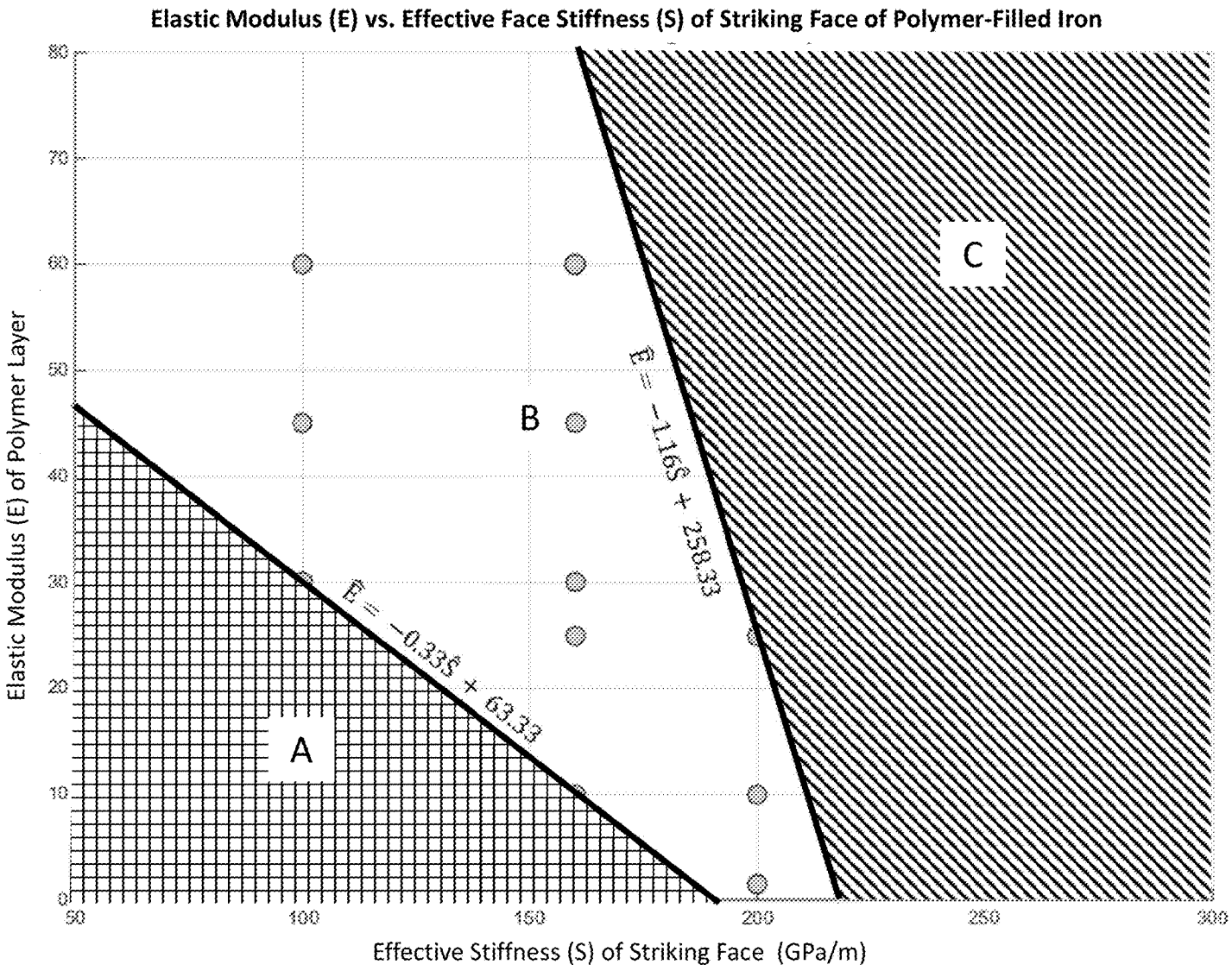
FIGS. 5B-5C depict annotated versions of the plot shown in FIG. 5A.

Some combinations of elastic modulus and effective face stiffness, however, may be unsuitable for golf clubs because either the golf club becomes too stiff resulting in poor COR and low ball speed performance or the stress becomes too high and the durability of the golf club is therefore too low. FIG. 5B depicts an annotated version of the plot depicted in FIG. 5A. The annotated plot in FIG. 5B identifies three regions: Region A, Region B, and Region C. Combinations of face thicknesses and elastic moduli in Region A may be undesirable because those combinations result in a golf club head that incurs high stress values that result in poor durability for the golf club head. For instance, for the combination of an elastic modulus of 10 MPa and an effective stiffness of 100 GPa/m, the golf club incurs a stress value (as shown in FIG. 5A), which would result in low durability for the golf club face. Region A is bounded by the axes and by the line $\hat{E}=-0.33\hat{S}+63.33$, wherein $\hat{E}$ is a unitless value equal to E/1 MPa and $\hat{S}$ is a unitless value equal to S/1 GPa/m. Thus, the values of E and S in Region A are any of combination of values greater than zero satisfying the inequality $\hat{E}\leq-0.33\hat{S}+63.33$.

In contrast, combinations of face thicknesses and elastic moduli in Region C may be unacceptable because the golf club face becomes too stiff, resulting in poor COR and low ball speed performance. For instance, for the combination of an elastic modulus of 60 MPa and an effective face stiffness of 200 GPa/m, the golf club has COR of 0.8037 (as shown in FIG. 5A), which may be too low for some golf club constructions. Region C is bounded on the lower end by the line $\hat{E}=-1.16\hat{S}+258.33$. Thus, the values of E and t in Region C are any a combination of values greater than zero satisfying the inequality $\hat{E}\geq-1.16\hat{S}+258.33$. Depending on the particular golf club construction there may be circumstances where combinations that fall within Regions A or C may be acceptable.

Combinations of face thicknesses and elastic moduli in Region B provide for more optimal durability and COR when incorporated into a golf club head. For instance, for the combination of an elastic modulus of 30 MPa and an effective face stiffness of 160 GPa/m, the golf club incurs stresses generally within the medium range and a COR of up to 0.8216 (as shown in FIG. 5A). Such a combination results in a golf club head that has strong durability qualities and high ball speed performance. Region B is bounded on lower end by the line $\hat{E}=-0.33\hat{S}+63.33$ and on the upper end by the line $\hat{E}=-1.16\hat{S}+258.33$. Accordingly, the values of E and S in Region B are any combination of values greater than zero satisfying the inequalities $\hat{E}\leq-1.16\hat{S}+258.33$ and $\hat{E}\geq-0.33\hat{S}+63.33$.

Figure 5C:
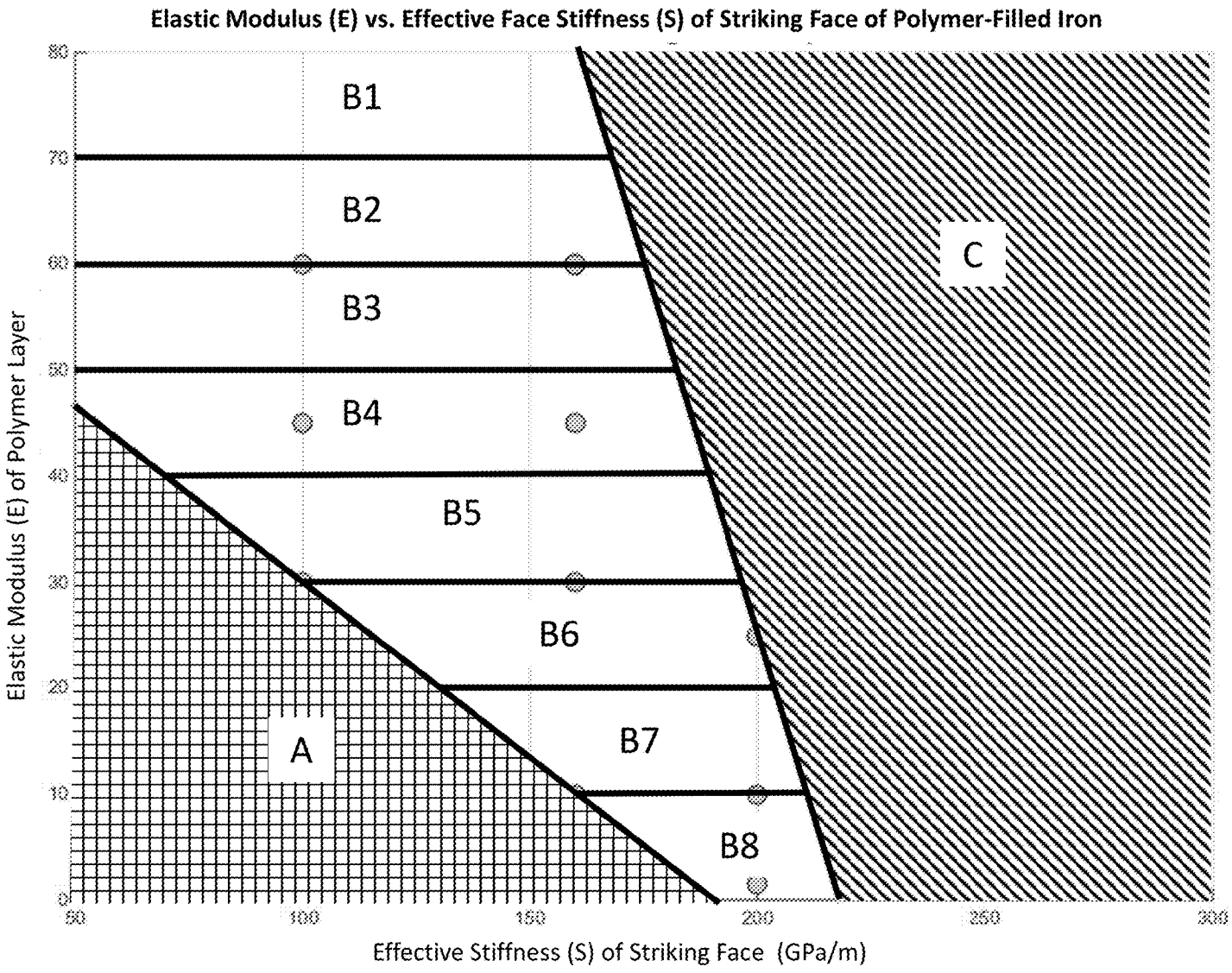

FIG. 5C is depicts another annotated version of the plot depicted in FIGS. 5A-5B. The plot depicted in FIG. 5C illustrates further Sub Regions B1-B8 of Region B. The particular sub regions may have uses in different golf club head technologies and applications. For instance, in golf club heads where additional support behind the striking face is desired, Sub Regions B1-B4 may be desirable, with Sub Region B1 providing for viscoelastic polymers having the highest elastic modulus (E). Sub Regions B5-B8 may be more suitable for golf club heads having striking faces requiring less support from the viscoelastic polymer, with least amount of support occurring in Sub Region B8. Sub Region B1 includes any combination of elastic modulus and face thickness satisfying the inequalities $\hat{E}\leq-1.16\hat{S}+258.33$ and $\hat{E}\geq70$. Sub Region B2 includes any combination of elastic modulus and face thickness satisfying the inequalities $\hat{E}\leq-1.16\hat{S}+258.33$; $\hat{E}\geq60$; and $\hat{E}<70$. Sub Region B3 includes any combination of elastic modulus and face thickness satisfying the inequalities $\hat{E}\geq-1.16\hat{S}+258.33$; $\hat{E}\geq50$; and $\hat{E}<60$. Sub Region B4 includes any combination of elastic modulus and face thickness satisfying the inequalities $\hat{E}\leq-1.16\hat{S}+258.33$; $\hat{E}\geq-0.33\hat{S}+63.33$; $\hat{E}\geq40$; and $\hat{E}<50$. Sub Region B5 includes any combination of elastic modulus and face thickness satisfying the inequalities $\hat{E}\leq-1.16\hat{S}+258.33$; $\hat{E}\geq-0.33\hat{S}+63.33$; $\hat{E}\geq30$; and $\hat{E}<40$. Sub Region B6 includes any combination of elastic modulus and face thickness satisfying the inequalities $\hat{E}\leq-1.16\hat{S}+258.33$; $\hat{E}\geq-0.33\hat{S}+63.33$; $\hat{E}\geq20$; and $\hat{E}<30$. Sub Region B7 includes any combination of elastic modulus and face thickness satisfying the inequalities $\hat{E}\leq-1.16\hat{S}258.33$; $\hat{E}\geq-0.33\hat{S}+63.33$; $\hat{E}\geq10$; and $\hat{E}<20$. Sub Region B8 includes any combination of elastic modulus and face thickness satisfying the inequalities $\hat{E}\leq-1.16\hat{S}+258.33$; $\hat{E}\geq-0.33\hat{S}+63.33$; and $\hat{E}<10$.

In some examples, the elastic modulus and striking face thickness are acceptable when the values for the elastic modulus and striking face thickness satisfy certain of one or more of the following inequalities: $\hat{E}*\hat{S}\leq9500$; $100\leq\hat{S}\leq2$; and $10\leq\hat{E}\leq75$. Such examples of golf clubs having a face thickness and elastic modulus satisfying those inequalities displays a COR and durability requirements that are generally acceptable for many applications.

Although specific embodiments and aspects were described herein and specific examples were provided, the scope of the invention is not limited to those specific embodiments and examples. One skilled in the art will recognize other embodiments or improvements that are within the scope and spirit of the present invention. Therefore, the specific structure, acts, or media are disclosed only as illustrative embodiments. The scope of the invention is defined by the following claims and any equivalents therein.

The invention claimed is:

1. A golf club head comprising:

a sole portion;

a topline;

a toe portion;

a heel portion;

a back portion;

a striking face having a thickness (t) between 1.2-1.9 mm and an effective stiffness (S), wherein the effective stiffness S is defined as $$S=\frac{E_{face}t}{A},$$

wherein $E_{face}$ is an elastic modulus of the material of the striking face and A is an impact area of the striking face;

a cavity defined by the sole portion, the topline, the toe portion, the heel portion, the back portion, and the striking face;

a viscoelastic polymer substantially filling the cavity and in contact with a rear surface of the striking face, wherein an elastic modulus (E), in megapascals (MPa), of the viscoelastic polymer is less than or equal to 40 MPa and the elastic modulus (E) has a relationship to the effective stiffness (S) of the striking face, in gigapascals per meter (GPa/m), defined by $\hat{E}\leq-1.16\hat{S}+258.33$ and $\hat{E}\geq-0.33\hat{S}+63.33$, wherein $\hat{E}$ is a unitless value equal to E/1 MPa and $\hat{S}$ is a unitless value equal to S/1 GPa/m; and wherein the golf club head displays a coefficient of restitution above 0.80, and wherein the golf club head is configured to produce, upon a strike of a golf ball, a sound having a plurality of modes including a mode between 2 kHz and 4 kHz, wherein a sound power of the mode between 2 kHz and 4 kHz is more than double the sound power of any other mode.

2. The golf club head of claim 1, wherein the thickness (t) is an average thickness of the striking face.

3. The golf club head of claim 1, wherein the thickness (t) is the maximum thickness of the striking face.

4. The golf club head of claim 1, wherein the polymer comprises at least one of butyl rubbers, butyl rubber ionomers, polyurethanes, polyureas, silicones, acrylate, methacrylates, foamed polymers, epoxies, styrene block copolymers, polybutadiene, nitrile rubber, thermoplastic vulcanizates, or thermoplastic elastomers.

5. The golf club head of claim 1, wherein the viscoelastic polymer has a tangent of delta peak temperature ($T_{tan\ \delta}$) between −70 degrees Celsius and −20 degrees Celsius at 1 Hz.

6. The golf club head of claim 5, wherein the tangent of delta peak temperature ($T_{tan\ \delta}$) satisfies the following inequalities $T_{Fox}-15 \leq T_{tan\ \delta} \leq T_{Fox}+15$ and $T_{GT}-15 \leq T_{tan\ \delta} \leq T_{GT}+15$, wherein $T_{Fox}$ is predicted glass transition temperature in Celsius from a Fox Equation, and $T_{GT}$ is a predicted glass transition temperature in Celsius from a Gordon-Taylor Equation.

7. A golf club head comprising:

a body and a striking face forming a hollow cavity, the striking face having a thickness (t) between 1.7-2.2 mm and an effective stiffness (S), wherein the effective stiffness S is defined as $$S = \frac{E_{face} t}{A},$$

wherein $E_{face}$ is an elastic modulus of the material of the striking face and A is an impact area of the striking face; and a viscoelastic polymer substantially filling the cavity and in contact with a rear surface of the striking face, wherein an elastic modulus (E), in megapascals (MPa), of the viscoelastic polymer is less than or equal to 40 MPa and the an elastic modulus (E) has a relationship to the effective stiffness (S) of the striking face, in gigapascals per meter (GPa/m), defined by $\hat{E} \leq -1.16\hat{S}+258.33$ and $\hat{E} \geq -0.33\hat{S}+63.33$, wherein $\hat{E}$ is a unitless value equal to E/1 MPa and $\hat{S}$ is a unitless value equal to S/1 GPa/m; and wherein the golf club head displays a coefficient of restitution above 0.80, and wherein the golf club head is configured to produce, upon a strike of a golf ball, a sound having a plurality of modes including a mode between 2 kHz and 4 kHz, wherein a sound power of the mode between 2 kHz and 4 kHz is more than double the sound power of any other mode.

8. The golf club head of claim 7, wherein the thickness (t) is an average thickness of the striking face.

9. The golf club head of claim 7, wherein the thickness (t) is the maximum thickness of the striking face.

10. The golf club head of claim 7, wherein the viscoelastic polymer comprises at least one of butyl rubbers, butyl rubber ionomers, polyurethanes, polyureas, silicones, acrylate, methacrylates, foamed polymers, epoxies, styrene block copolymers, polybutadiene, nitrile rubber, thermoplastic vulcanizates, or thermoplastic elastomers.

11. The golf club head of claim 7, wherein the viscoelastic polymer has a tangent of delta peak temperature ($T_{tan\ \delta}$) between −70 degrees Celsius and −20 degrees Celsius at 1 Hz.

12. The golf club head of claim 11, wherein the tangent of delta peak temperature ($T_{tan\ \delta}$) satisfies the following inequalities $T_{Fox}-15 \leq T_{tan\ \delta} \leq T_{Fox}+15$ and $T_{GT}-15 \leq T_{tan\ \delta} \leq T_{GT}+15$, wherein $T_{Fox}$ is predicted glass transition temperature in Celsius from a Fox Equation, and $T_{GT}$ is a predicted glass transition temperature in Celsius from a Gordon-Taylor Equation.

13. A golf club head comprising:

a sole portion;

a topline;

a toe portion;

a heel portion;

a back portion;

a striking face having a thickness (t) between 1.2-1.9 mm and an effective stiffness (S), wherein the effective stiffness S is defined as $$S = \frac{E_{face} t}{A},$$

wherein $E_{face}$ is an elastic modulus of the material of the striking face and A is an impact area of the striking face;

a cavity defined by the sole portion, the topline, the toe portion, the heel portion, the back portion, and the striking face;

a viscoelastic polymer substantially filling the cavity and in contact with a rear surface of the striking face, wherein an elastic modulus (E), in megapascals (MPa), of the viscoelastic polymer is less than or equal to 40 MPa, and the elastic modulus (E) has a relationship to the effective stiffness (S) of the striking face, in gigapascals per meter (GPa/m), defined by $\hat{E} \geq -0.33\hat{S}+63.33$, wherein $\hat{E}$ is a unitless value equal to E/1 MPa and $\hat{S}$ is a unitless value equal to S/1 GPa/m; and wherein the golf club head displays a coefficient of restitution above 0.80, and wherein the golf club head is configured to produce, upon a strike of a golf ball, a sound having a plurality of modes including a mode between 2 kHz and 4 kHz, wherein a sound power of the mode between 2 kHz and 4 kHz is more than double the sound power of any other mode.

14. The golf club head of claim 13, wherein the thickness (t) is an average thickness of the striking face.

15. The golf club head of claim 13, wherein the thickness (t) is the maximum thickness of the striking face.

16. The golf club head of claim 13, wherein the viscoelastic polymer has a tangent of delta peak temperature ($T_{tan\ \delta}$) between −70 degrees Celsius and −20 degrees Celsius at 1 Hz.

* * * * *